US011154149B2

(12) United States Patent
Nishida

(10) Patent No.: US 11,154,149 B2
(45) Date of Patent: Oct. 26, 2021

(54) DRINKING DRAMATIZATION GLASS

(71) Applicant: NETAPPLI CO., LTD., Ishikawa (JP)

(72) Inventor: Makoto Nishida, Ishikawa (JP)

(73) Assignee: NETAPPLI CO., LTD., Ishikawa (JP)

( * ) Notice: Subject to any disclaimer, the term of this patent is extended or adjusted under 35 U.S.C. 154(b) by 0 days.

(21) Appl. No.: 17/053,350

(22) PCT Filed: Apr. 3, 2020

(86) PCT No.: PCT/JP2020/015349
§ 371 (c)(1),
(2) Date: Nov. 5, 2020

(87) PCT Pub. No.: WO2020/230471
PCT Pub. Date: Nov. 19, 2020

(65) Prior Publication Data

US 2021/0244213 A1 Aug. 12, 2021

(30) Foreign Application Priority Data

May 10, 2019 (JP) ..... JP2019-099764

(51) Int. Cl.
*A47G 19/22* (2006.01)

(52) U.S. Cl.
CPC ..... *A47G 19/2227* (2013.01)

(58) Field of Classification Search
CPC .. A47G 19/025; A47G 19/2227; A47G 23/16; A63H 33/22; B65D 25/54; B65D 77/24
(Continued)

(56) References Cited

U.S. PATENT DOCUMENTS

2003/0226849 A1* 12/2003 Hoffbauer ..... A47G 19/2227 220/662
2008/0100469 A1 5/2008 Goldburt
(Continued)

FOREIGN PATENT DOCUMENTS

CN 203676736 U 7/2014
CN 104545239 A 4/2015
(Continued)

OTHER PUBLICATIONS

International Search Report (ISR) dated Jun. 23, 2020, issued for International application No. PCT/JP2020/015349. (3 pages).

*Primary Examiner* — James N Smalley
*Assistant Examiner* — Madison L Poos
(74) *Attorney, Agent, or Firm* — Law Office of Katsuhiro Arai

(57) ABSTRACT

An object of the present invention is to provide a drinking dramatization glass that is lightweight and allows images to be projected on the side face of the glass by changing their aspect ratio according to the size of the glass.
The drinking dramatization glass 1 comprises: a glass body 10 being a bottomed cylinder with a top opening 11 and having, on its side face, a flat part 20 and a curved part 30, both made of a transparent material; and a fixing mechanism 40 for fixing an image display device 80 on the flat part 20 in such a way that its image display surface 81 faces the flat part 20; wherein such drinking dramatization glass is characterized in that: the curved part 30 has, on the side contacted by a drink L filled in the glass body 10, a curved surface 31 that curves along the curved part 30; the curved surface 31 has radii of curvature R that, when an image 82 projected on the image display surface 81 is viewed from the exterior side of the glass body 10 through the drink L and curved part 30, allows for viewing of a virtual image 83 which is an enlarged version of the image 82; and the radius
(Continued)

(a)

(b)

of curvature in the vertical direction RV, and the radius of curvature in the horizontal direction RH, of the curved surface 31, are different.

20 Claims, 7 Drawing Sheets

(58) Field of Classification Search
USPC ..... 215/382, 383, 390; 220/662, 663, 669, 220/676, 703, DIG. 13; 446/77, 219
See application file for complete search history.

(56) References Cited

U.S. PATENT DOCUMENTS

| | | | | |
|---|---|---|---|---|
| 2009/0321458 | A1* | 12/2009 | Blair | A47G 19/2227 220/709 |
| 2011/0088296 | A1* | 4/2011 | Schnuckle | G09F 19/16 40/409 |
| 2016/0198877 | A1* | 7/2016 | Ni | B65D 23/12 455/575.1 |

FOREIGN PATENT DOCUMENTS

| | | | |
|---|---|---|---|
| CN | 208017316 | U | 10/2018 |
| JP | 2005099159 | A | 4/2005 |
| JP | 2016002451 | A | 1/2016 |
| JP | 6337256 | B1 | 6/2018 |
| JP | 6406742 | B1 | 10/2018 |
| JP | 6432960 | B1 | 12/2018 |
| JP | 6488049 | B1 | 3/2019 |

* cited by examiner

[FIG. 1]
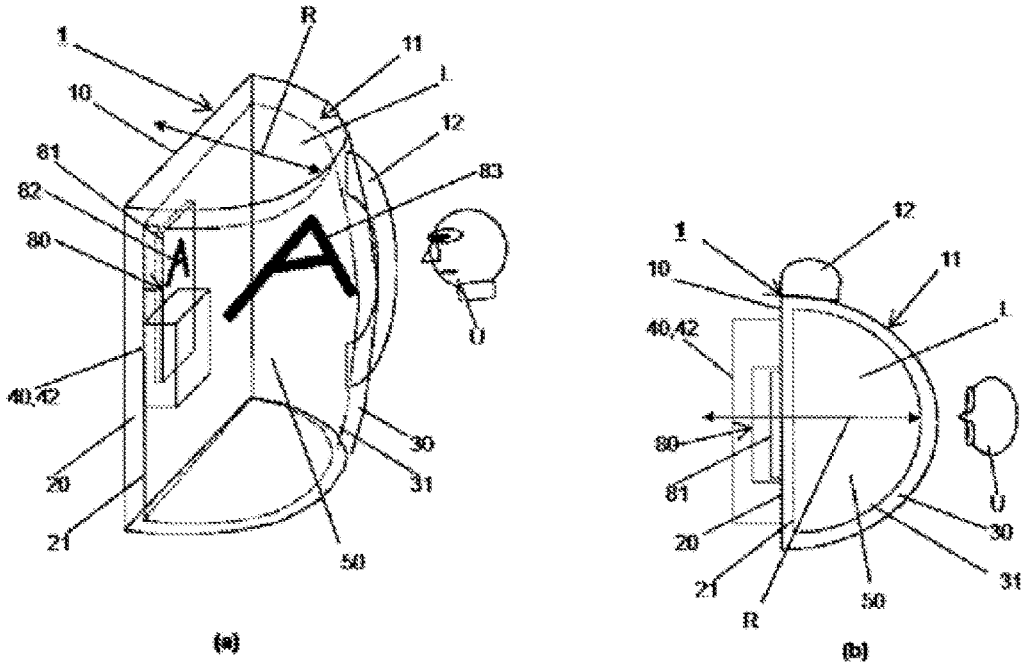
[FIG. 2]
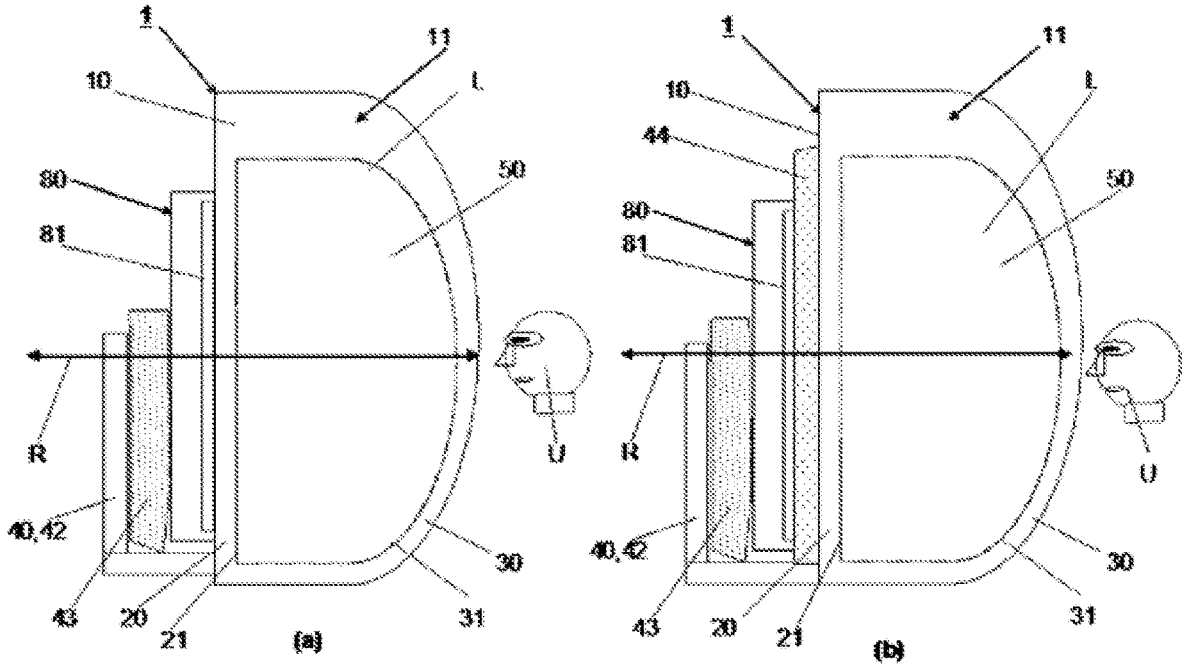

[FIG. 3]
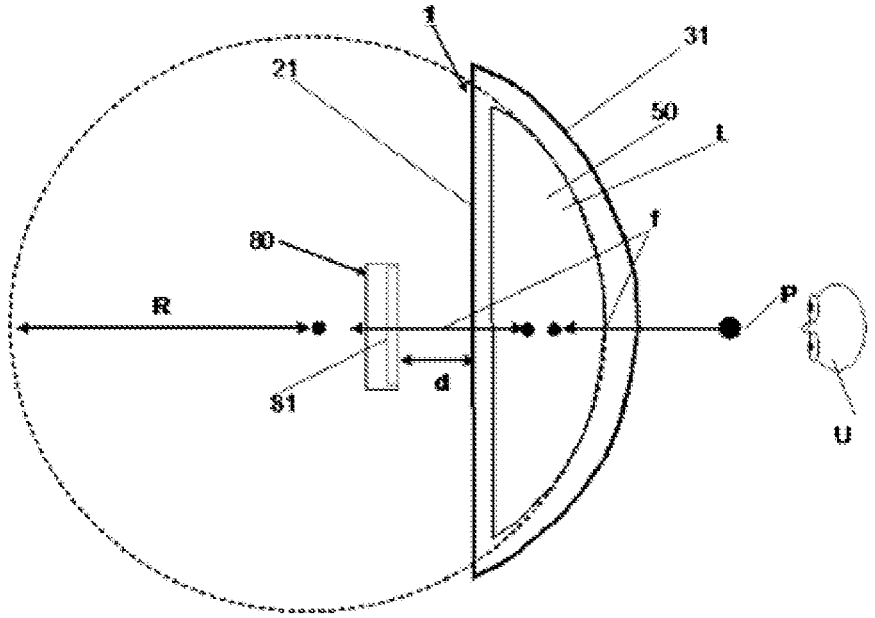
$$f \fallingdotseq \frac{R}{n-1} \quad \text{--- Formula 1}$$
$$M \fallingdotseq \frac{250}{f} \quad \text{--- Formula 2} \qquad M \fallingdotseq \frac{250}{f} + 1 \quad \text{--- Formula 3}$$

[FIG. 4]
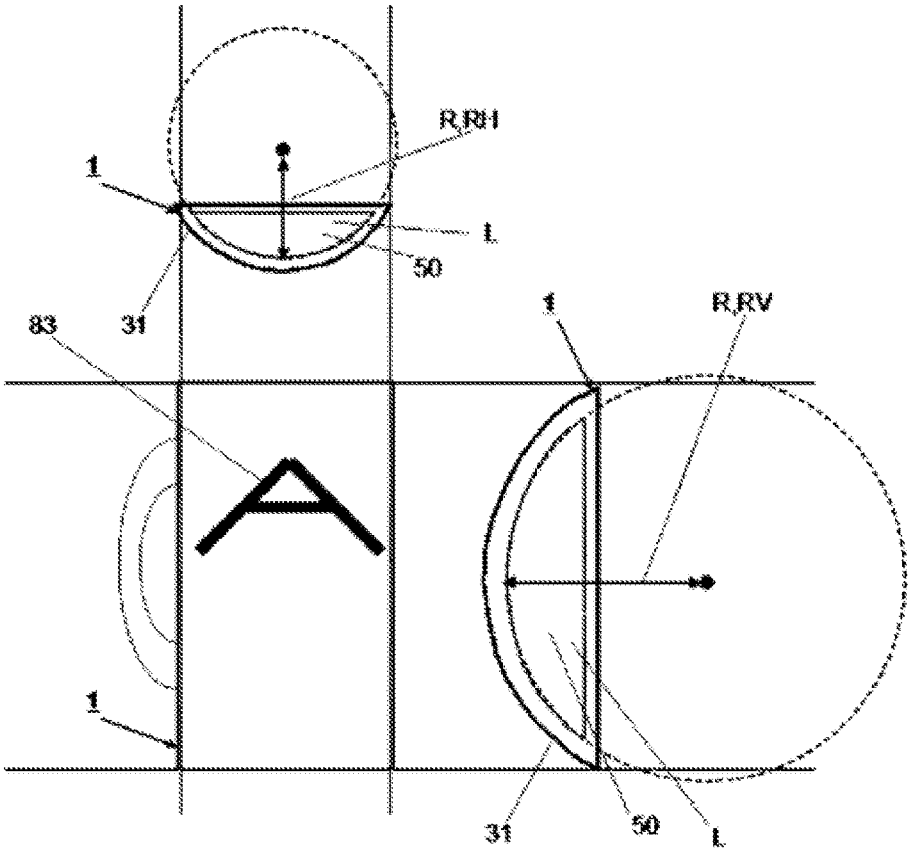
RH<RV
[FIG. 5]
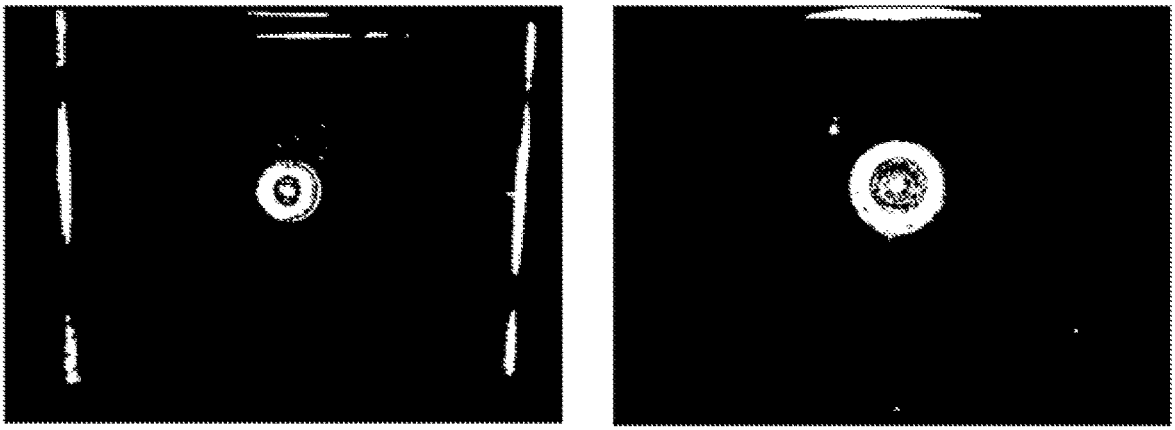
(a) (b)

[FIG. 6]
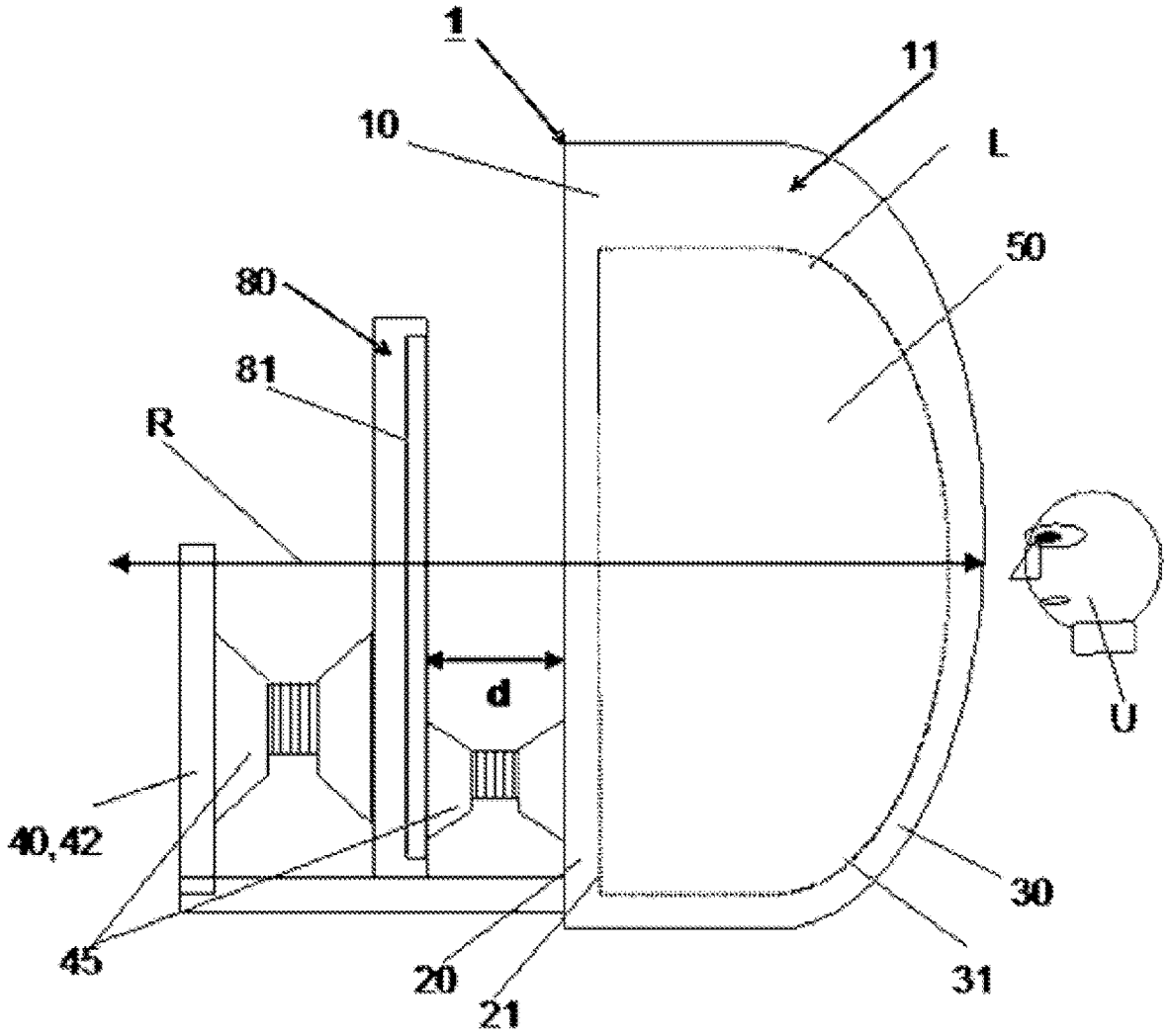

[FIG. 7]
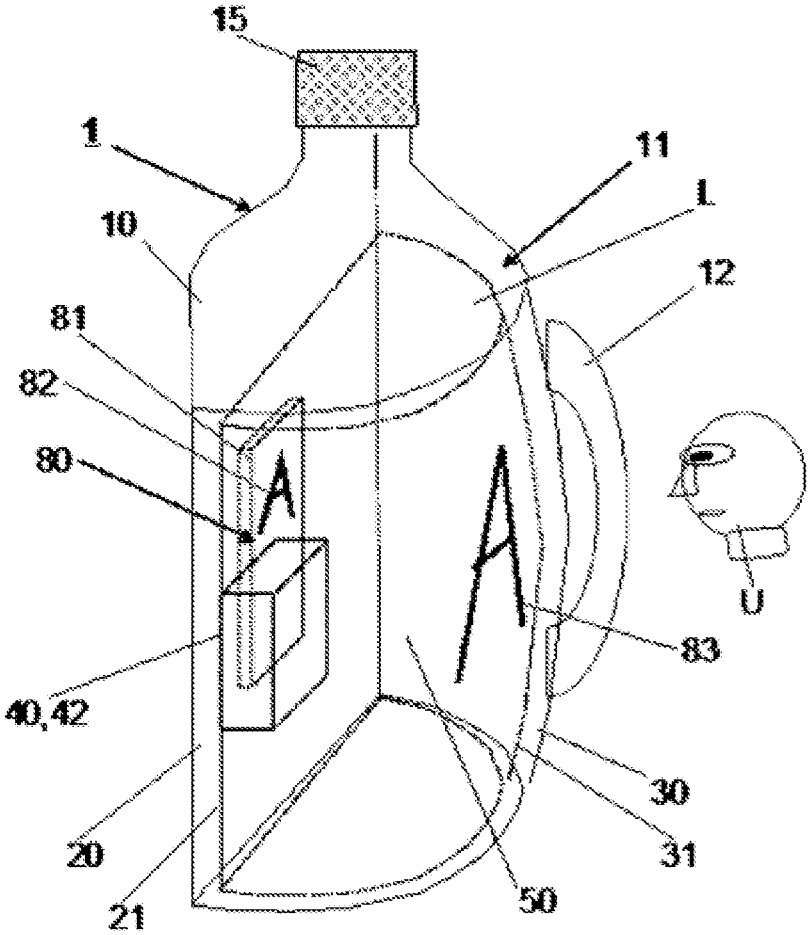

[FIG. 8]
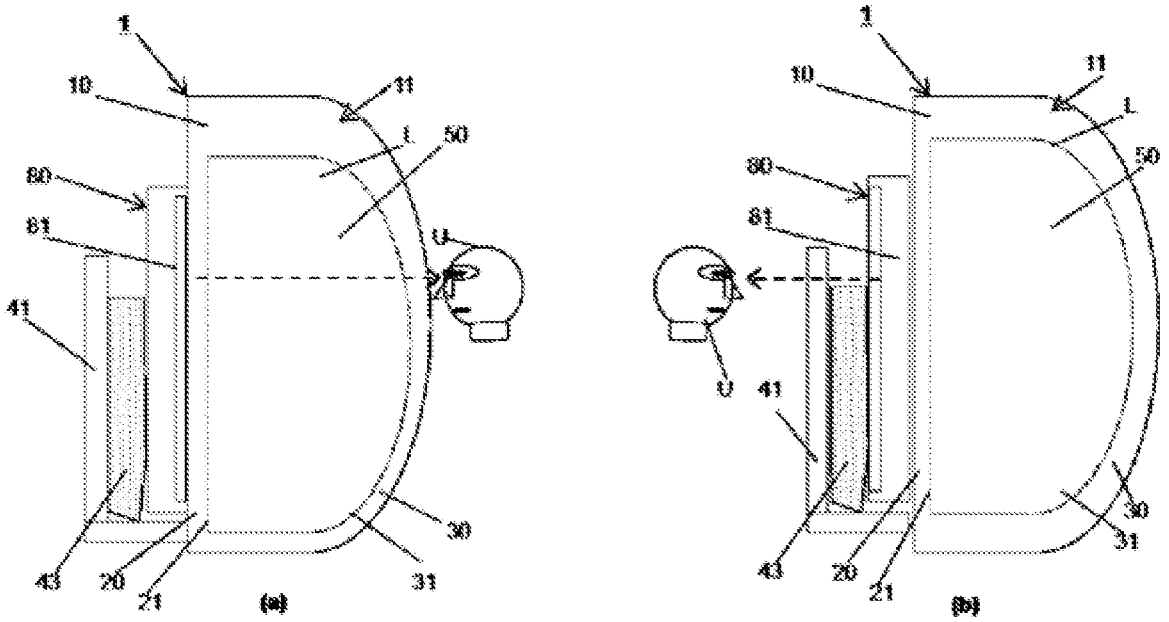

[FIG. 9]
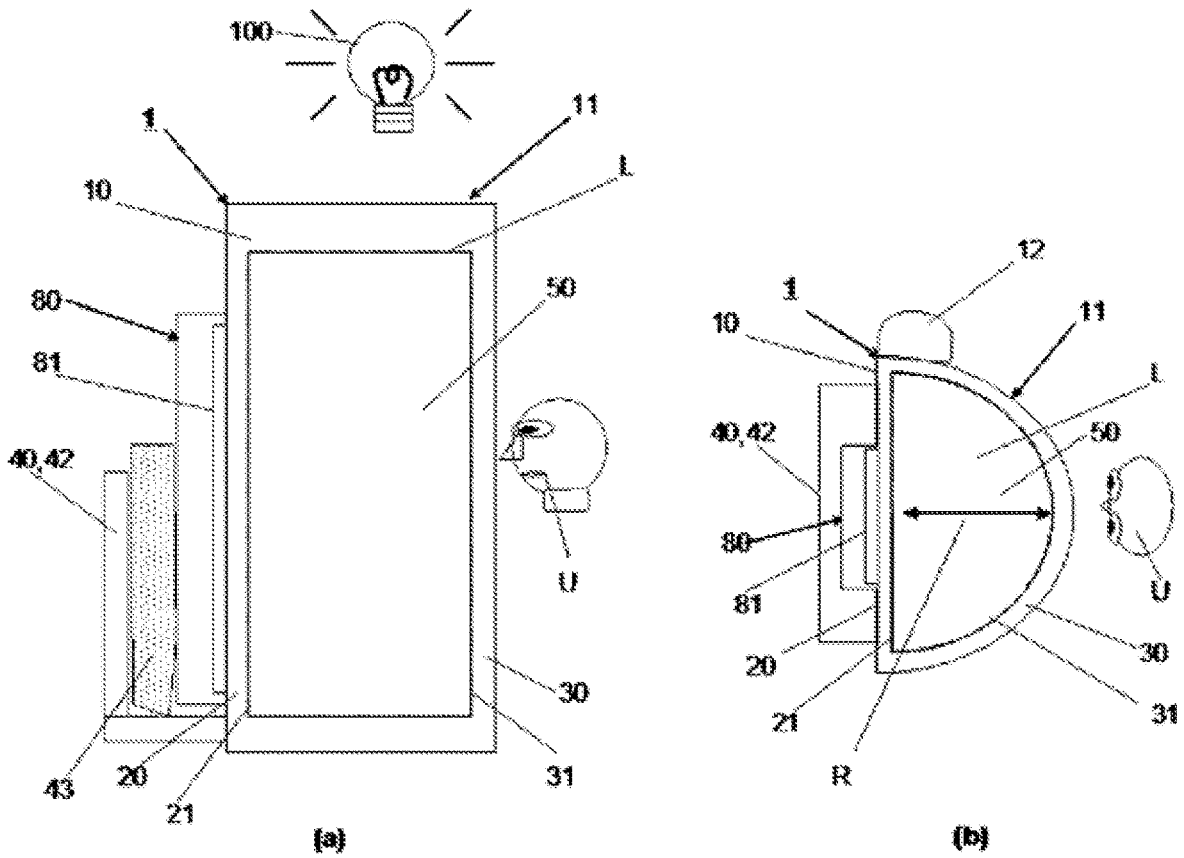

DRINKING DRAMATIZATION GLASS

Cross-Reference to Related Applications

This application is the U.S. National Phase under 35 U.S.C. §371 of International Application PCT/JP2020/015349, filed Apr. 3, 2020, which claims priority to Japanese Patent Application No. JP2019-099764, filed May 10, 2019. The International Application was published under PCT Article 21(2) in a language other than English.

TECHNICAL FIELD

The present invention relates to a drinking dramatization glass featuring a function to change the aspect ratio of images, as well as a function to enlarge displayed images, using a liquid inside the glass.

BACKGROUND ART

Glasses offering various functions in addition to containing drinks have been developed.

For example, Patent Literatures 1 and 2 disclose an art of placing a display device on the surface of a glass and allowing the image displayed on the display device to be changed manually or according to the output of a motion sensor that detects the state of the glass.

Patent Literatures 3 to 5 disclose a drinking dramatization glass invented by the inventor of the invention under the present application for patent. This drinking dramatization glass comprises: a glass body; a storage part extending from the bottom part, toward the interior side, of the glass body and used for storing a mobile communication device; and a waveguide part extending from the side face, toward the interior side, of the glass body and used for letting the radio waves from the mobile communication device pass through. This drinking dramatization glass can let the radio waves from the mobile communication device pass through to the exterior to enable wireless communication, even when a drink is filled inside the glass body.

Patent Literature 6 discloses a drinking dramatization glass invented by the inventor of the invention under the present application for patent. This drinking dramatization glass comprises an image display device fixed on the side face of the glass and a reflective mirror placed inside the glass body, and the glass allows for dramatization based on pseudo-projection of the image from the image display device onto the interior of the glass.

BACKGROUND ART LITERATURE

Patent Literature

Patent Literature 1: Japanese Patent Laid-open No. 2005-99159
Patent Literature 2: U.S. Patent Laid-open No. 2008/0100469
Patent Literature 3: Japanese Patent No. 6337256
Patent Literature 4: Japanese Patent No. 6406742
Patent Literature 5: Japanese Patent No. 6432960
Patent Literature 6: Japanese Patent No. 6488049

SUMMARY OF THE INVENTION

Problems to Be Solved by the Invention

However, Patent Literatures 1 to 4 mentioned above present problems in that, when dealing with images containing fine print, etc., visually recognizing such text is difficult unless the images are enlarged, which makes the glass difficult to use for individuals having presbyopia or astigmatism.

Patent Literatures 5 and 6 mentioned above present problems in that, because the constitution is such that a lens for enlarging images is provided separately on the side face of the glass, the weight of the glass body increases by at least several hundred grams [g] or so even when a lens small enough to cover an image display device of approx. 5 inches in size is used, which makes the glass difficult to use for women and children with weak muscles.

Furthermore, Patent Literatures 1 to 6 mentioned above all present problems in that the aspect ratio of images cannot be changed according to the size or shape of the glass.

In light of the aforementioned problems, an object of the present invention is to provide a drinking dramatization glass that is lightweight and allows images to be projected on the side face of the glass by changing their aspect ratio according to the size of the glass.

Means for Solving the Problems

The drinking dramatization glass proposed by the present invention comprises: a glass body being a bottomed cylinder with a top opening and having, on its side face, a flat part made of a transparent material and a curved part made of a transparent material; and a fixing mechanism for fixing an image display device on the flat part in such a way that its image display surface faces the flat part; wherein such drinking dramatization glass is characterized in that: the curved part is placed at a position opposite the flat part; the curved part curves in a convex shape toward the exterior side of the glass body; the curved part has, on the side contacted by a drink filled in the glass body, a curved surface that curves along the curved part; the flat part has a planar flat surface on the side contacted by the drink; the flat part is a constitutive part of the side face of the glass body; the curved surface has radii of curvature that, when an image projected on the image display surface is viewed from the exterior side of the glass body through the drink and curved part, allows for viewing of a virtual image which is an enlarged version of the aforementioned image; and the radius of curvature in the vertical direction, and the radius of curvature in the horizontal direction, of the curved surface, are both a finite value.

Also, the drinking dramatization glass proposed by the present invention is characterized in that the radius of curvature of the curved surface in the vertical direction is different from the radius of curvature of the curved surface in the horizontal direction.

Also, the drinking dramatization glass proposed by the present invention is characterized in that the fixing mechanism is made of a transparent material.

The drinking dramatization glass proposed by the present invention is characterized in that the fixing mechanism has an adjuster mechanism that can change the distance between the image display surface and the flat part.

Also, the drinking dramatization glass proposed by the present invention is characterized in that it has a sheet made of a transparent, stretchable and air-impermeable material disposed between the flat part and the image display surface, and the fixing mechanism causes the image display surface and the flat part to tightly adhere to each other via the sheet.

Also, the drinking dramatization glass proposed by the present invention is characterized in that the fixing mechanism is a pocket structure made of a transparent material.

Also, the drinking dramatization glass proposed by the present invention is characterized in that it has a spacer to be inserted into the pocket structure, and the spacer is made of a stretchable and transparent material.

Also, the drinking dramatization glass proposed by the present invention is characterized in that the pocket structure is made of a pliable material.

Also, the drinking dramatization glass proposed by the present invention is characterized in that the radius of curvature of the curved surface in the vertical direction is equal to the radius of curvature of the curved surface in the horizontal direction.

Also, the drinking dramatization glass proposed by the present invention is characterized in that it has a lid for closing off the top opening.

Effects of the Invention

Because the side face of the glass body is constituted in a manner having the flat part and the curved part, each made of a transparent material, the shape of the drink (liquid) inside the glass body can be made identical to the shape of a plano-convex lens whose face on one side is flat and opposite face on the other side is convex, which makes it possible to enlarge and display to the user any image on the image display surface of the image display device fixed on the flat part. This is because the drink inside the glass body, which has changed its shape to one conforming to the flat part and the curved part, becomes a light refraction medium (the refractive index of water is approx. 1.333) and functions as a plano-convex lens.

Because the lens is integrated with the drink in the glass body, the weight of the glass body can be reduced.

By adjusting the values of the radii of curvature of the surface of the curved part on the side contacted by the drink (hereinafter simply referred to as "curved surface"), the magnification factor and focal distance of the image as viewed from the user can be adjusted.

By setting different values for the radius of curvature in the vertical direction and radius of curvature in the horizontal direction, of the curved surface, the image transmitting through the drink in the glass can be enlarged by changing its aspect ratio.

This means that the aspect ratio of the image on the side face of the glass can be changed according to the shape and size of the glass.

By setting the radius of curvature in the vertical direction and radius of curvature in the horizontal direction, of the curved surface, equal, the image can be enlarged without changing its aspect ratio.

By making the radius of curvature of the curved surface in the vertical direction infinitely large, that is, by shaping the glass body as a column that does not curve in the vertical direction, glare caused by a ceiling light or other light source reflecting on the curved part or curved surface on the side face of the glass body can be prevented for comfortable image viewing.

Making the distance between the flat part and the image display surface variable allows the user to change the magnification factor and focus of the image seen through the drink inside the glass.

By sliding the image display device in the horizontal direction relative to the flat part, only a given area of the image can be enlarged.

Dramatization effects can be achieved by coloring the image on the side face of the glass according to the color of the drink.

Dramatization effects can be achieved by changing the image magnification factor for each drink, because the optical refractive index varies from one type of drink to another.

Tilting the glass body causes the image inside the glass to also tilt synchronously according to the angle of the glass, which can be used to dramatize a toast, etc.

Because the image display device can be fixed on the glass body in a state where the flat part and the image display surface of the image display device are fully and tightly adhering to each other, air can be eliminated from between the image display surface and the flat part and consequently fogging of (condensation on) the image display surface can be prevented.

The image display surface can be fixed sturdily on the flat part simply by applying pressure (or tension) with a spring mechanism, rubber belt mechanism, etc., in the direction of pressing the image display surface against the flat part, and as this happens, the stress received by the image display surface from the flat part is distributed over the area and dispersed to prevent the image display surface from being damaged by the flat part.

Normally a convex lens, including a plano-convex lens, produces a larger image of a target object when the distance between the object and the lens is longer (just like how a magnifying glass works). Accordingly, the image magnification factor can be increased or decreased by controlling the thickness of the glass in the flat part.

By disposing between the flat part and the image display surface a sheet made of a transparent, pliable, and air-impermeable material, fogging of (condensation on) the image display surface can be prevented and, furthermore, the image magnification factor can be increased or decreased by controlling the thickness of this sheet.

Use of a pocket structure as the fixing mechanism for fixing the image display device on the glass body not only prevents the image display device from coming off the glass when the glass is tilted, but it also makes installing and removing the image display device easy. Also, when an elastic material is used as the spacer to be inserted into the pocket structure, not only can image display devices and mobile phones of various thickness sizes be fixed on the side face of the glass, but their image display surface can also be kept in a constantly-pressured state against the flat part by the stress due to the elasticity of the spacer, which increases the fixing strength of the image display device. It should be noted that both the pocket structure and spacer may be constituted by a transparent material to allow the user to accurately see the fixed position of the image display device, which facilitates fine-tuning of the fixing position, and sliding, of the image display device.

When the pocket structure or other fixing mechanism for fixing the image display device on the glass body is entirely made of a transparent material, images can be viewed regardless of whether the image display device is oriented toward the interior side of the glass or the exterior side of the glass. This means that the drinking dramatization glass proposed by the present invention can be reversed for switching between a normal use mode where images are transmitted through a drink in the glass body to be enlarged for viewing, and a use mode where images are viewed directly without being transmitted through the drink.

BRIEF DESCRIPTION OF THE DRAWINGS

[FIG. 1] A perspective view (a), and a top cross-sectional view (b), showing the drinking dramatization glass in the first embodiment.

[FIG. 2] Cross-sectional views (a), (b) of examples where a pocket structure is adopted as the fixing mechanism.

[FIG. 3] A drawing showing a calculation example of the focal distance and magnification factor of a plano-convex lens.

[FIG. 4] A drawing showing the relationship between the radii of curvature of the curved surface in the vertical direction and horizontal direction, and the aspect ratio to which the image is enlarged.

[FIG. 5] Photographs (a), (b), each of a halftone image shown on the display to indicate the distribution of transmitted light that has transmitted through the curved surface, as viewed from the front of the glass.

[FIG. 6] A cross-sectional view of an example where the distance between the flat part and the image display surface is made variable.

[FIG. 7] A perspective view showing a bottle-shaped drinking dramatization glass.

[FIG. 8] Cross-sectional views (a), (b) showing the drinking dramatization glass in the second embodiment.

[FIG. 9] Cross-sectional views (a), (b) showing the drinking dramatization glass in the third embodiment.

MODE FOR CARRYING OUT THE INVENTION

[First Embodiment of Drinking Dramatization Glass]

The first embodiment of the drinking dramatization glass proposed by the present invention is described below using drawings.

As shown in FIG. 1, the drinking dramatization glass 1 is roughly constituted by a glass body 10, a flat part 20, a flat surface 21, a curved part 30, a curved surface 31, and a fixing mechanism 40.

The glass body 10 is a bottomed cylinder with a top opening 11, allowing a soft drink, alcoholic drink, or other liquid L to be filled inside. The material for the glass body 10 may be glass, resin, ceramic, porcelain, etc., just like for general glasses.

The glass body 10 has, on its side face, a planar flat part 20 made of a transparent material, while the flat part 20 has a planar flat surface 21 on the side contacted by the drink L filled inside the glass body 10.

The flat part 20 is provided for the purpose of fixing an image display device 80 on the glass body 10 in a stable manner, while letting the light constituting an image 82 on the image display device 80 transmit through it toward the opposing curved part 30. Because the flat part 20 is planar, causing it to tightly adhere to an image display surface 81 of the image display device 80 allows air to be eliminated from between the image display surface 81 and the flat part 20, which in turn prevents condensation on the flat part 20 and image display surface 81.

The glass body 10 has, on its side face at a position facing the flat part 20, a curved part 30 made of a transparent material and curving in a convex shape toward the exterior side of the glass body 10, while the curved part 30 has, on the side contacted by the drink L filled inside the glass body 10, a curved surface 31 that curves along the curved part 30. The curved part 30 is provided for the purpose of letting the user U on the exterior of the glass body 10 view a virtual image 83 which is an enlarged image representing an enlarged version of the image 82.

The fixing mechanism 40 is a member for fixing the image display device 80 on the flat part 20. The fixing mechanism 40 fixes the image display device 80 on the flat part 20 in a state where its image display surface 81 is facing toward the flat part 30. In this embodiment, a pocket structure 42, like the one shown in FIG. 1 and FIG. 2, is provided as the fixing mechanism 40; however, the drinking dramatization glass proposed by the present invention is not limited to this, and a rubber belt mechanism, clamp mechanism, etc., may be used as the fixing mechanism 40.

As for the shape of the glass body 10, it may be a so-called mug type having a handle 12 as shown in FIG. 1, or a bottle type having a lid 15 to close off the top opening 11 as shown in FIG. 7.

The flat part 20 (flat surface 21 to be exact) and curved part 30 (curved surface 31 to be exact) cause the shape of the drink L filled inside the glass to become identical to the shape of a plano-convex lens whose face on one side is level and opposite face on the other side is convex, which makes it possible to display to the user U a virtual image 83 which is an enlarged version of the image 82 on the image display device 80 fixed on the flat part 20.

This is explained by water having a refractive index of approx. 1.333 which is higher than the refractive index of air, thus causing the drink L, which has taken the shape of a plano-convex lens in conformance to the flat part 21 and the curved part 31, to become a light refraction medium and function as a plano-convex lens 50. It should be noted that, since the curved surface 31 is curved, its radius of curvature R is always a finite value.

Since the optical refractive index varies from one type of drink L to another (for example, the refractive index of pure water is approx. 1.33, while the refractive index of sugar water of 20% in concentration is approx. 1.37), the drinking dramatization glass 1 proposed by the present invention can achieve dramatization effects by changing the image magnification factor for each type of drink L.

FIG. 3 is a drawing showing a calculation example of the focal distance and magnification factor of a plano-convex lens.

As shown in Formula 1, the focal distance f of a plano-convex lens 50 is known to approximate the value obtained by dividing R by n−1, where n represents the refractive index of the light refraction medium of the lens, while R represents the radius of curvature of the convex part of the plano-convex lens 50 (for details, refer to technical books on optical science or on formulas of lenses). In the meantime, when a virtual image (enlarged version of an image) is formed at a position 250 [mm] away from the eyes (this is called "distance of distinct vision"), the magnification factor M indicating by how many times the virtual image is larger than the actual image is known to approximate the value obtained by dividing 250 by f according to Formula 2, or by adding 1 to the resulting value of dividing 250 by f according to Formula 3, where f represents the focal distance of the lens (for details, refer to technical books on lenses and optical science). This goes to show that the magnification factor of the image 82 can be increased by decreasing the radius of curvature R of the curved surface 31 according to Formula 1 and Formula 2, or according to Formula 1 and Formula 3.

FIG. 4 is a drawing showing the relationship between the radii of curvature of the curved surface in the vertical direction and horizontal direction, and the aspect ratio to which the image is enlarged.

Since the radius of curvature R of the curved surface 31 can be a radius of curvature in horizontal direction RH or radius of curvature in vertical direction RV, as shown in FIG. 4, the aspect ratio of the virtual image 83, which is an enlarged image, can be changed from the aspect ratio of the actual image 82 by setting different values for the radius of curvature RH and radius of curvature RV. For example, setting the value of the radius of curvature in horizontal direction RH smaller than the value of the radius of curvature in vertical direction RV makes the virtual image 83 look stretched in the horizontal direction, as shown in FIG. 4. Conversely, setting the value of the radius of curvature RH greater than the value of the radius of curvature RV makes the virtual image 83 look stretched in the vertical direction. In other words, the aspect ratio and magnification factor of the virtual image 83 can be adjusted according to the size, aspect ratio, shape, and design of the glass body by adjusting the radius of curvature RH and the radius of curvature RV to different values. Additionally, by setting the value of the radius of curvature RH equal to that of the radius of curvature RV, or, put differently, by shaping the curved surface 31 spherical, the image 82 and the virtual image 83 can have an equal aspect ratio.

Note that, when designing a glass, caution should be exercised not to set the radius of curvature RH or radius of curvature RV to an unnecessarily small value to raise the magnification factor, as it may lead to notable distortion, with the virtual image 83 distorting significantly only in the outer peripheral part.

As is evident from Formula 1 and Formula 2 or Formula 3 in FIG. 3, one requirement for making the virtual image 83, which is an enlarged version of the image 82, viewable by the user U is that the radius of curvature R is a finite value. So long as the radius of curvature R is a finite value, the virtual image 83 becomes larger than the image 82, even if by only a little, no matter how large a value the radius of curvature R takes. However, the ability to recognize how much the image 82 has been enlarged is affected by the visual acuity, ocular globe diameter/size and many other parameters and thus varies from one individual to another (for details, refer to technical books on lenses and optical science). Accordingly, caution should be exercised not to produce a glass body 10 using an excessively large value of radius of curvature (such as in the order of several meters), as some users may not be able to recognize the enlargement effect of the image 82 because the magnification factor is too small.

When producing glasses conforming to the present invention, it would be good to select values of their radii of curvature RH, RV in a range of several centimeters to several tens of centimeters by considering realistic radii and magnification factors of glasses.

For reference, photographs (a), (b), each of a halftone image shown on the display to indicate the distribution of transmitted light that has transmitted through the curved surface, as viewed from the front of the glass, using a glass whose radius of curvature RH and radius of curvature RV are both infinitely large and a glass whose radius of curvature RH and radius of curvature RV are both 5 [cm], are shown in FIG. 5. FIG. 5 (a) represents an output of the distribution, based on computer-aided brightness analysis, of the light that has transmitted through a cube-shaped glass of 10 [cm] per side having no curved surface 31 (that is, a glass whose radius of curvature RH and radius of curvature RV are both infinitely large) as photographed from the front of the curved surface. On the other hand, FIG. 5(*b*) represents an output of the distribution, based on computer-aided brightness analysis just like in FIG. 5(*a*), of the light that has transmitted through a glass having a curved surface 31 whose radius of curvature in horizontal direction RH and radius of curvature in vertical direction RV are equal (spherical glass whose radius of curvature RH and radius of curvature RV are both 5 [cm]) as photographed from the front of the curved surface. It should be noted that, for the purpose of comparison, the glasses in FIGS. 5(*a*), (*b*) were both filled with a liquid that had been colored to the same concentration (colored with black coffee) as the drink L, and photographed using the same point light source by being positioned in contact with the point light source, followed by downloading of the obtained images to a computer for analysis of transmitted light. Also, with both FIGS. 5(*a*), (*b*), a computer image analysis software was used to perform brightness analysis, where the distribution pattern of transmitted light was output by expressing areas whose brightness was equal to or above the threshold of 87.5 [%] (224 bits in the 256 shades of gray) in white, while showing areas of lower brightness in black, in order to produce an easy-to-understand graphic representation in black and white for use as a drawing to accompany the Specification.

Comparing FIG. 5(*a*) and FIG. 5(*b*) finds that the glass of FIG. 5(*b*) enlarges the transmitted image of the point light source by approx. 1.8 times more compared to FIG. 5(*a*), suggesting that, when the radius of curvature is 5 [cm], images can be enlarged at a high magnification to the extent that most users can sufficiently recognize the enlarged effect. Also, in FIG. 5(*b*), the transmitted light from the point light source remains roughly a true circle that has been enlarged at an equal aspect ratio. It should be noted that, besides decreasing the radius of curvature R, another way to raise the magnification factor of the image 82 is to increase the distance between the glass body 10 and the image display surface 81 (this is the same principle that governs magnifying glasses, obtained from the formulas of lenses). If the radius of curvature R cannot be decreased for any reason relating to the glass design, etc., this method may be used concurrently.

As shown in FIG. 2 and FIG. 6, use of a pocket structure 42 as the fixing mechanism 40 prevents the image display device 80 from coming off the glass body 10 even when the glass body 10 is tilted for toasting and drinking, and it also allows for installation and removal of the image display device 80 to/from the glass simply by sliding it horizontally relative to the flat part 20.

As shown in FIG. 2, use of an elastic material for a spacer 43 to be inserted into the pocket structure 42 not only allows image display devices and mobile phones of various thickness sizes to be fixed on the side face of the glass, but it can also keep their image display surface 81 in a constantly-pressured state against the flat part 20 by the stress due to the elasticity of the spacer 43, which increases the fixing strength of the image display device. It should be noted that both the pocket structure 42 and spacer 43 may be constituted by a transparent material to allow the user U to accurately see the fixed position of the image display device 80 from any direction, which facilitates fine-tuning of the fixing position, and sliding, of the image display device 80. It should be noted that, in addition to glass, acrylic or other solid material, a pliable, transparent material such as polyvinyl chloride may be used as the material for the pocket structure 42, in which case the glass body 10 can be made smaller and lighter.

Normally a convex lens, including plano-convex lens, produces a larger image of a target object when the distance between the object and the lens is longer (just like how a magnifying glass works). Accordingly, the glass proposed by the present invention permits the magnification factor of the image 82 to be increased or decreased by controlling the thickness of the glass in the flat part 20; alternatively, a sheet 44 made of a transparent, pliable, and air-impermeable material may be disposed between the flat part 20 and the image display surface 81, as shown in FIG. 2(*b*), so as to increase or decrease the image magnification factor by increasing or decreasing the thickness of this sheet 44. Among the advantages of this method are that the image display surface 81 can be protected from the flat part 20 due to the sheet 44, and that condensation on the image display surface 81 can be prevented (because air does not enter between the image display surface 81 and the flat surface).

As shown in FIG. 6, an adjuster mechanism 45 capable of changing the distance d between the image display surface 81 and the flat part 20 may be provided to let the user U adjust the image magnification factor by himself/herself. It should be noted that, for the adjuster mechanism 45, it suffices that any known screw mechanism, etc., for adjusting distance is used.

[Second Embodiment of Drinking Dramatization Glass]

The second embodiment of the drinking dramatization glass proposed by the present invention is explained below using drawings; it should be noted, however, that locations constitutionally identical to those in the drinking dramatization glass 1 in the aforementioned first embodiment are denoted with the same symbols and not explained.

The drinking dramatization glass in this embodiment uses, as its fixing mechanism 40, a fixing mechanism 41 made of a transparent material (such a pocket structure 42 made of transparent glass) as shown in FIG. 8, so that viewing of image is possible regardless of whether the image display device 80 is oriented toward the interior side of the glass body 10 as shown in FIG. 8(*a*) or toward the exterior side of the glass body 10 as shown in FIG. 8(*b*). This means that the drinking dramatization glass in this embodiment can be reversed for switching between a normal use mode where the image 82 is transmitted through the drink L in the glass body 10 to be enlarged for viewing, and a use mode where it is viewed directly without being transmitted through the drink L.

[Third Embodiment of Drinking Dramatization Glass]

The third embodiment of the drinking dramatization glass proposed by the present invention is explained below using drawings; it should be noted, however, that locations constitutionally identical to those in the drinking dramatization glass 1 in the aforementioned first embodiment are denoted with the same symbols and not explained.

The drinking dramatization glass in this embodiment is such that, as shown in FIG. 9, its glass body has a columnar shape not curving in the vertical direction, that is, the curved surface 31 has an infinitely large value as its radius of curvature in vertical direction RV. This way, glare caused by a ceiling light 100 or other light source reflecting on the curved part 30 or curved surface 31 on the side face of the glass body 10 can be prevented for comfortable image viewing.

Industrial Field of Application

The present invention relates to a drinking dramatization glass comprising a glass body whose side face is constituted by a transparent flat surface and a transparent curved surface, wherein such drinking dramatization glass uses a plano-convex lens, being a drink inside the glass body used as a light refraction medium, to enlarge images on an image display device provided on the side face of the glass. Since the lens, the drink inside the glass, and the image display device, are integrated into one body, clear images can be enlarged by transmitting them through the drink in the glass, while the glass body can also be made lighter. Using a transparent fixing mechanism, the image display device can be fixed in a reversible manner, as well. Based on the above, the present invention has industrial applicability.

Description of the Symbols

L Drink (liquid)
d Distance (distance between the flat part and the image display surface)
R Radius of curvature
RV Radius of curvature (in the vertical direction)
RH Radius of curvature (in the horizontal direction)
P Focal point
n Refractive index
f Focal distance
M Magnification factor
U User
1 Drinking dramatization glass
10 Glass body
11 Top opening
12 Handle
15 Lid
20 Flat part
21 Flat surface
30 Curved part
31 Curved surface
40 Fixing mechanism
41 Fixing mechanism (transparent)
42 Pocket structure
43 Spacer
44 Sheet
45 Adjuster mechanism
50 Plano-convex lens
80 Image display device
81 Image display surface
82 Image
83 Virtual image (enlarged version of the image)
100 Ceiling light

What is claimed is:

1. A drinking dramatization glass comprising:

a glass body being a bottomed cylinder with a top opening and having, on its side face, a flat part made of a transparent material and a curved part made of a transparent material; and a fixing mechanism for fixing an image display device on the flat part in such a way that its image display surface faces the flat part;

the drinking dramatization glass characterized in that:

the curved part is placed at a position opposite the flat part;

the curved part curves in a convex shape toward an exterior side of the glass body;

the curved part has, on a side contacted by a drink filled in the glass body, a curved surface that curves along the curved part;

the flat part has a planar flat surface on a side contacted by the drink;

the flat part is a constitutive part of a side face of the glass body;

the curved surface has radii of curvature that, when an image projected on the image display surface is viewed from an exterior side of the glass body through the drink and curved part, allows for viewing of a virtual image which is an enlarged version of the image; and a radius of curvature in a vertical direction, and a radius of curvature in a horizontal direction, of the curved surface, are both a finite value.

2. The drinking dramatization glass according to claim 1, characterized in that the radius of curvature of the curved surface in the vertical direction is different from the radius of curvature of the curved surface in the horizontal direction.

3. The drinking dramatization glass according to claim 1, characterized in that the fixing mechanism is made of a transparent material.

4. The drinking dramatization glass according to claim 1, characterized in that the fixing mechanism has an adjuster mechanism that can change a distance between the image display surface and the flat part.

5. The drinking dramatization glass according to claim 1, characterized in that it has a sheet made of a transparent, stretchable and air-impermeable material between the flat part and the image display surface, and the fixing mechanism causes the image display surface and the flat part to tightly adhere to each other via the sheet.

6. The drinking dramatization glass according to claim 1, characterized in that the fixing mechanism is a pocket structure made of a transparent material.

7. The drinking dramatization glass according to claim 6, characterized in that it has a spacer to be inserted into the pocket structure, and the spacer is made of a stretchable and transparent material.

8. The drinking dramatization glass according to claim 6, characterized in that the pocket structure is made of a pliable material.

9. The drinking dramatization glass according to claim 1, characterized in that the radius of curvature of the curved surface in the vertical direction is equal to the radius of curvature of the curved surface in the horizontal direction.

10. The drinking dramatization glass according to claim 1, characterized in that it has a lid for closing off the top opening.

11. The drinking dramatization glass according to claim 2, characterized in that the fixing mechanism is made of a transparent material.

12. The drinking dramatization glass according to claim 2, characterized in that the fixing mechanism has an adjuster mechanism that can change a distance between the image display surface and the flat part.

13. The drinking dramatization glass according to claim 2, characterized in that it has a sheet made of a transparent, stretchable and air-impermeable material between the flat part and the image display surface, and the fixing mechanism causes the image display surface and the flat part to tightly adhere to each other via the sheet.

14. The drinking dramatization glass according to claim 2, characterized in that the fixing mechanism is a pocket structure made of a transparent material.

15. The drinking dramatization glass according to claim 2, characterized in that it has a lid for closing off the top opening.

16. The drinking dramatization glass according to claim 3, characterized in that the fixing mechanism has an adjuster mechanism that can change a distance between the image display surface and the flat part.

17. The drinking dramatization glass according to claim 3, characterized in that it has a sheet made of a transparent, stretchable and air-impermeable material between the flat part and the image display surface, and the fixing mechanism causes the image display surface and the flat part to tightly adhere to each other via the sheet.

18. The drinking dramatization glass according to claim 3, characterized in that the fixing mechanism is a pocket structure made of a transparent material.

19. The drinking dramatization glass according to claim 3, characterized in that it has a lid for closing off the top opening.

20. The drinking dramatization glass according to claim 4, characterized in that it has a sheet made of a transparent, stretchable and air-impermeable material between the flat part and the image display surface, and the fixing mechanism causes the image display surface and the flat part to tightly adhere to each other via the sheet.

* * * * *